United States Patent [19]

Rich

[11] 4,156,513

[45] May 29, 1979

[54] READER RACK

[75] Inventor: Beverly C. Rich, Baltimore, Md.

[73] Assignee: Worcester Wire Manufacturing Co., Timonium, Md.

[21] Appl. No.: 765,901

[22] Filed: Feb. 7, 1977

[51] Int. Cl.[2] ..... E01B 7/00

[52] U.S. Cl. ..... 248/451; 248/441 D

[58] Field of Search ..... 248/504, 451, 452, 453, 248/441 D; 211/42, 181

[56] References Cited

U.S. PATENT DOCUMENTS

| | | | |
|---|---|---|---|
| 202,790 | 4/1878 | Clark | 248/453 |
| 240,739 | 4/1881 | Lohges | 248/451 |
| 939,942 | 11/1909 | Brauchli | 248/452 |
| 1,038,280 | 9/1912 | Burnett | 248/451 |
| 1,131,261 | 3/1915 | Olsen | 248/504 |
| 1,161,339 | 11/1915 | Putnam | 248/452 |
| 1,269,925 | 6/1918 | Gauntt | 248/452 |
| 1,581,063 | 4/1926 | Keese | 248/453 |
| 2,369,348 | 2/1945 | Gore | 248/451 |
| 3,800,958 | 8/1972 | Dorn | 211/181 X |

OTHER PUBLICATIONS

Easel Publication, Division 8, Dec. 4, 1906, U.S. Patent Office.

*Primary Examiner*—Roy D. Frazier
*Assistant Examiner*—Peter A. Aschenbrenner
*Attorney, Agent, or Firm*—Walter G. Finch

[57] ABSTRACT

This invention is for an improved print-out reader rack for use in the computer industry or the like for supporting a binder having print-out sheets contained therein. This rack consists of a carbon steel rod framework having two parallel spaced sides inclined upwardly and terminating in vertical legs for positioning the sides at an angle to the horizontal. Cross filler members are positioned between the sides to give rigidity to the framework. The front of the rack is formed angularly upwardly to receive the back of the binder. A weighted arm is pivotally mounted to one side of the rack to hold sheets of a binder in operative position.

5 Claims, 4 Drawing Figures

READER RACK

BACKGROUND AND SUMMARY OF THE INVENTION

This invention relates to a support stand, and more particularly to a print-out reader rack for use in the computer industry.

In the past, it has been very difficult to support the print-out sheets of a computer in position so that they can be quickly and accurately read by a user thereof.

It is an object of this invention to provide a "no hands" reader rack which can be used for convenience of the reader of print-out sheets in a computer binder.

Another object of this invention is to provide a reader rack which provides reader convenience for awkward to read open upper page of unburst computer print-out binders.

And another object of this invention is to provide a read-out rack which has a framework with a slanted surface which provides convenient reading angle and a traction grip hold down arm to keep the sheets of the binder open, leaving the hands free for making notes and tabulations.

Another object of this invention is to provide a pivotally mounted weighted arm for a reader rack that easily swings out of position to permit turning of the sheets of the binder.

Also another object of this invention is to provide a reader rack that is either rubber or plastic tipped to prevent sliding or marking of furniture tops, such as tables or desks.

DESCRIPTION OF THE PREFERRED EMBODIMENT

Figures 1, 2, 3, 4:
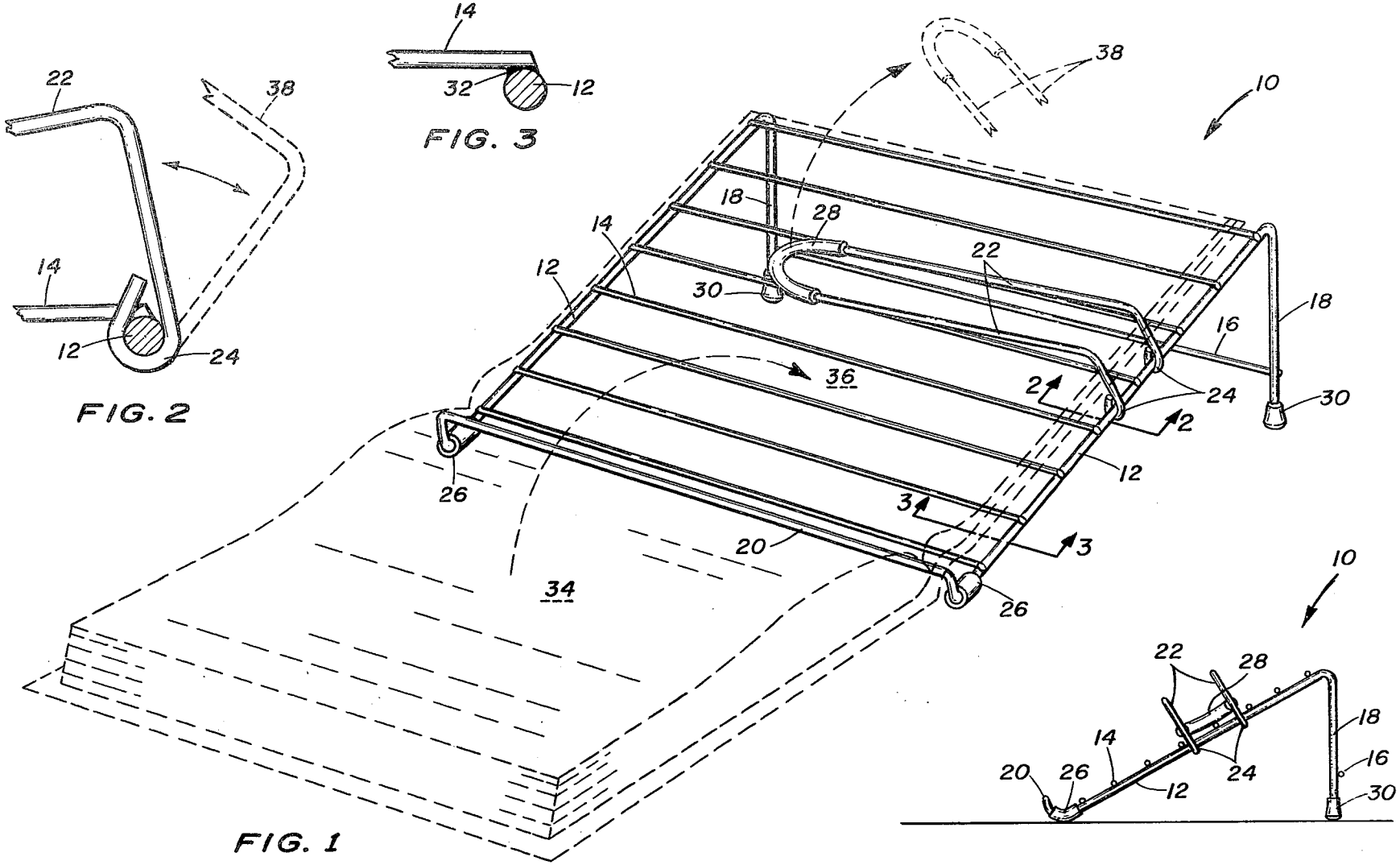
FIG. 1 is a perspective view of a print-out reader rack incorporating features of my invention.
FIG. 2 is a cross section of a portion of the reader rack taken along line 2—2 of FIG. 1.
FIG. 3 is a cross section of another portion of the reader rack taken along line 3—3 of FIG. 1.
FIG. 4 is a side elevation of the reader rack of FIG. 1.

Referring now to FIG. 1 of the drawing, there is shown a print-out reader rack 10 which consists of a framework having two inclined sides 12, legs 18 formed substantially angularly to the respective sides 12, and a front lip 20, all integrally formed from a rod of carbon steel or similar material. A support 16, also of carbon steel, is welded to the legs 18 to keep the legs 18 from spreading apart.

The sides 12, as best seen in FIGS. 1 and 4 are formed at an angle to the horizontal, with the legs 18 being so formed as to be substantially vertical when the framework is placed on a horizontal base, such as a table or desk or the like.

The free end of each leg 18 is provided with a rubber or plastic protective sleeve 30. In addition, where the sides 12 join the lip 20, rubber or plastic protective sleeves 26 are positioned on the sides 12. These rubber or plastic protective sleeves 26 and 30 prevent damage to the base, such as a table or desk, that the print-out reader rack 10 is placed for operational use.

The lip 20 at the front of the reader rack 10 is formed and inclined angularly to the sides 12 so as to mate with the back of the binder 34, having print-out sheets 36 contained therein, as best shown in FIG. 1.

A plurality of parallel spaced cross filler wires 14 are positioned between the sides 12 of the rack 10, and they are resistant welded at their ends by welds 32 to the sides 12 to form a sturdy and strong reader rack 10, as shown best in FIGS. 1, 3, and 4.

Referring now to FIGS. 1, 2, and 4, a pivotally mounted holddown arm 22 is provided to provide a weight for holding the sheets 36 of the binder 34 in a fixed position. This holddown arm 22 is formed of a carbon steel rod formed in the form of a "U", having the ends of the legs of the "U" bent a small angle to the main plane of the "U" and formed as hinges 24 around one of the sides 12 of the reader rack 10 and arranged to be pivoted about the side 12. The arm 22 extends approximately one-half to two-thirds the width of the reader rack 10.

A rubber or plastic protective sleeve 28 is provided at the bend of the "U" arm 22 so as to prevent damage to the sheets 36 of the binder 34 when the weighted arm 22 is placed down on the sheets 36 of the binder 34.

The holddown 22 is shown in a raised position 38 so that the sheets 36, with the binder can be placed on the reader rack 10, or removed therefrom as desired, as best shown in FIG. 1.

As can be readily understood the aforegoing description of the invention, the present structure can be configured in different modes to provide the ability for various arrangements of the reader rack. Such configuring in different modes that utilize the novel and unique concepts of this invention are within the scope and intent of this invention.

What is claimed is:

1. A reader rack for holding the sheets of a binder of an unburst computer printout, comprising:

an integrally formed framework having a pair of substantially vertical legs at the rear end thereof and a pair of substantially parallel inclined downwardly side members extending forward from said legs and integral therewith, said side members being connected at the forward end by a transverse upturned lip member and integral therewith;

a support member connected to said legs of said integrally formed framework;

at least one transverse cross filler member connected to said parallel inclined side members of said integrally formed framework; and an independently operated pivotally mounted weighted hold-down arm, said weighted hold-down arm being pivotally mounted on one of said inclined side members of said integrally formed framework, said hold-down arm consisting of a substantially "U" shaped arm, positioned to one side of said reader rack, said "U" shaped arm extending from one side of said reader rack to a point between said parallel inclined side members greater than one-half the distance between said parallel sides, and having the free ends of said "U" shaped arm formed downward a short distance at the side of said framework and said free ends bent in a loop around said side member of said framework to serve as a hinge, thereby establishing pivotable mounting of said pivotally mounted weighted hold-down arm.

2. A reader rack as recited in claim 1, wherein said transverse cross filler member is welded at its two ends to upper surface of said pair of substantially parallel side members, the first end of said filler member being welded to the first said member and the second end of said filler member being welded to the second said side member of said pair of side members, said filler member being parallel to said lip member.

3. A reader rack as recited in claim 2, and additionally a plurality of additional filler members spaced from first said filler member and welded to said pair of substantially parallel side members in a manner similar to welding of said first filler member to said side members, and all said additional filler members parallel to each other and to said lip member.

4. A reader rack as recited in claim 1 and additionally, a protective covering on the ends of said legs and protective covering on said side members at said upturned lip member where said downward ends of said side members are slightly upturned and integrally connected to said lip member to prevent damage to the operational base, such as a desk or table, where said legs and a portion of said side members at said upturned lip member interface with said operational base.

5. A reader rack as recited in claim 1 and additionally a protective covering on said "U" shaped end of said "U" shaped arm.

* * * * *